US006060847A

United States Patent [19]

Hettema et al.

[11] Patent Number: 6,060,847

[45] Date of Patent: May 9, 2000

[54] INTERACTIVE AMUSEMENT RIDE

[75] Inventors: Philip D. Hettema, Los Angeles; Craig Hanna, Universal City; John R. Murdy, Universal City; Nicholas H. Drobnis, Universal City, all of Calif.

[73] Assignee: Universal Studios, Inc., Universal City, Calif.

[21] Appl. No.: 09/112,258

[22] Filed: Jul. 8, 1998

[51] Int. Cl.[7] ..... H02P 5/46

[52] U.S. Cl. ..... 318/66; 318/560; 318/568.16; 318/586; 318/580; 318/587; 381/43

[58] Field of Search ..... 318/66, 560, 568.16, 318/586, 580, 587; 381/43

[56] References Cited

U.S. PATENT DOCUMENTS

| | | | |
|---|---|---|---|
| 5,361,705 | 11/1994 | Powell | 318/586 X |
| 5,453,053 | 9/1995 | Danta et al. | 318/586 X |
| 5,629,595 | 5/1997 | Salter et al. | 318/586 X |

*Primary Examiner*—Karen Masih
*Attorney, Agent, or Firm*—Lyon & Lyon LLP

[57] ABSTRACT

An amusement ride provides an interactive experience to its passengers. The amusement ride includes at least one ride vehicle movable along a track. The amusement ride senses inputs from at least one passenger that affects various elements of the ride. The elements can be the speed of the vehicle, acceleration of the vehicle, direction of travel, orientation of the ride vehicle or the like. The inputs can be audible inputs or optical inputs, water spray, or can be activated manually by the passengers.

22 Claims, 4 Drawing Sheets

INTERACTIVE AMUSEMENT RIDE

FIELD OF THE INVENTION

The present invention relates to amusement rides and, more particularly, to an interactive amusement ride that senses inputs from the passengers and affects various elements of the ride.

BACKGROUND OF THE INVENTION

Amusement rides are a staple in theme parks, amusement parks, carnivals, fairs, family entertainment centers and the like. In a typical amusement ride, a vehicle seats at least one passenger and moves in at least one direction. Often, the vehicle moves along a track or other pathway and its speed, direction of travel, acceleration and movement are predetermined by the ride manufacturer or operator. For example, in a roller coaster, a vehicle moves along a track. The track can include a number of hills, loops, curves and dips. The direction of travel is determined by the track layout. The speed and acceleration of the vehicle are determined by many factors, including the height of the lift hill, the affects of friction and wind resistance and the overall track layout. External devices, such as linear induction motors or linear synchronous motors are known in the art and may be used to accelerate the vehicle to a predetermined speed at a specific location on the track. In such an amusement ride, the passenger cannot control the speed, the acceleration, the movement or the direction of travel of the vehicle. These are all design features that are fixed at the time the ride is designed.

To enhance the ride experience, it would be advantageous to allow the passengers to control some aspect of the vehicle's speed, acceleration, movement or direction of travel.

SUMMARY OF THE INVENTION

An amusement ride detects an event performed by at least one passenger. The detection of the passenger event changes vehicle speed, acceleration, movement, direction of travel or other elements of the ride. In the preferred embodiment, the amusement ride comprises a vehicle that rides along a track or other path. The passenger event detected may be movement of a passenger's limb or the passenger's voice. The ride therefore includes an interactive element, such that the passengers can influence some characteristics of the ride or the environment around the ride.

DETAILED DESCRIPTION

Figure 1:
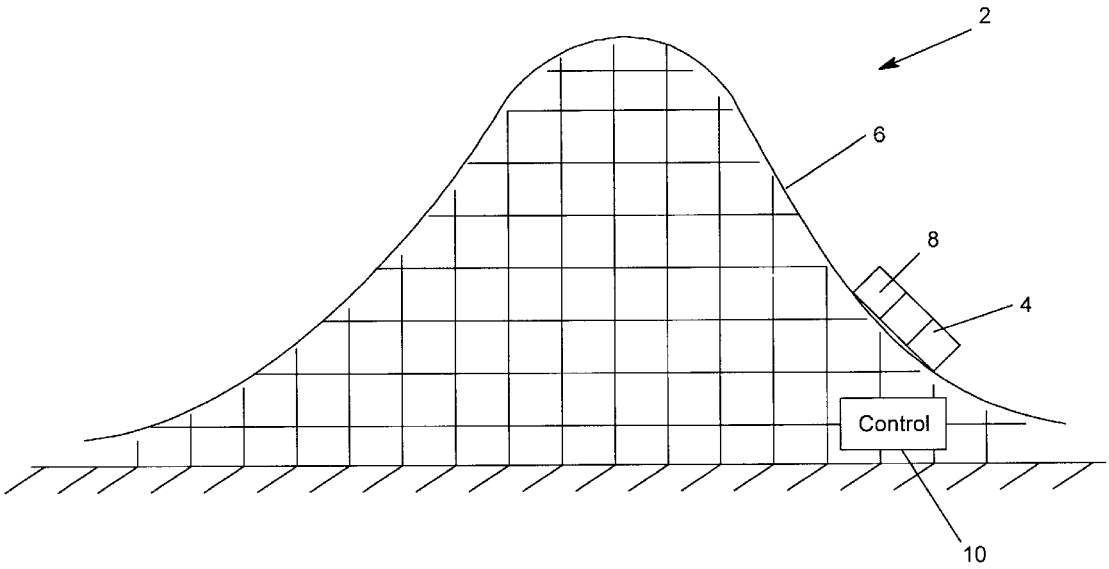
FIG. 1 is a schematic showing a first embodiment of the amusement ride of the present invention.
Figure 2:
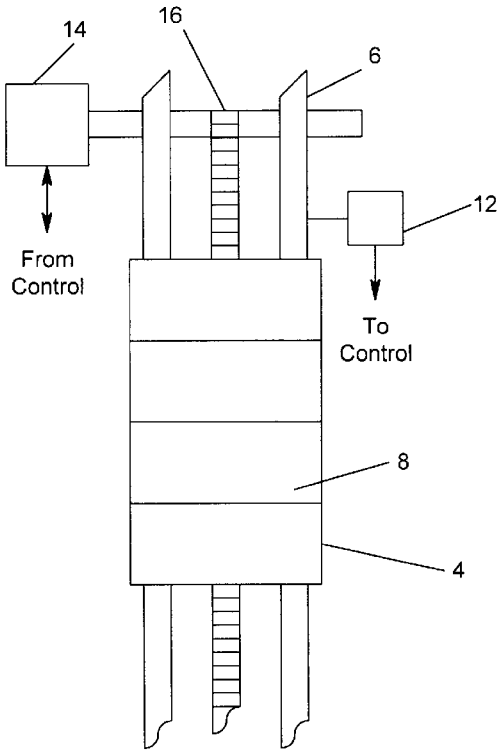
FIG. 2 is a plan view of the first embodiment of the amusement ride of the present invention.

As shown in FIGS. 1 and 2, an amusement ride 2 includes a track 6 and a vehicle 4 movable along the track 6. The vehicle 4 includes a number of cars 8, with each car 8 being able to seat at least one passenger. The amusement ride 2 further includes a sensor or detector 12 for detecting inputs from the vehicle 4. The detector 12 may be a microphone that detects the level of screaming or laughing from all of the passengers. The detector 12 may also be an optical sensor, such as a digital camera that detects when the passengers raise their hands. Additionally, the detector 12 may be a voice recognition system that would recognize specific words.

Figure 6:
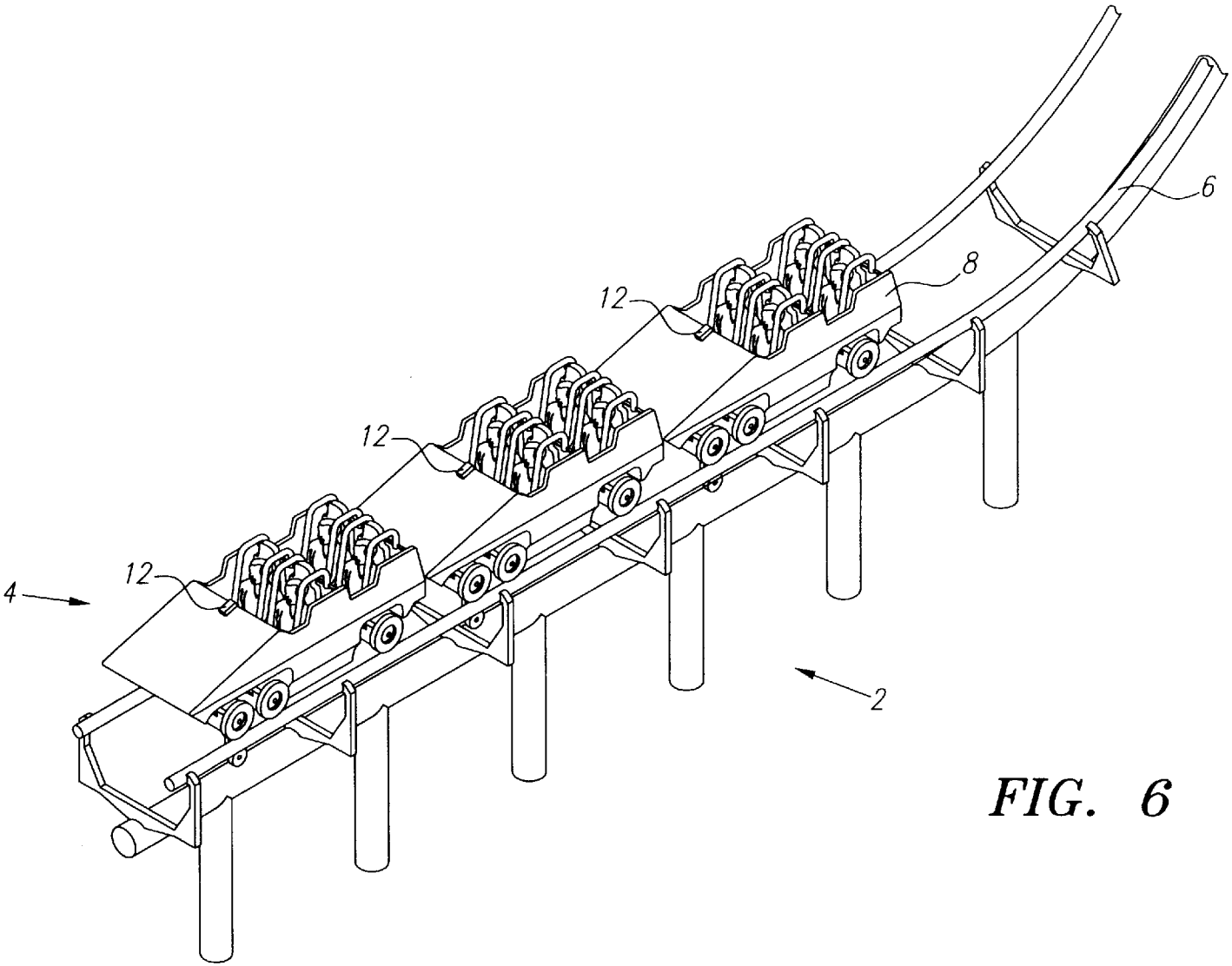
FIG. 6 is a perspective view of the embodiment shown in FIG. 1.

A control system is linked to the detector 12. The control system 10 varies at least one parameter of the vehicle 4 in response to an input from the detector. Parameters can include acceleration and/or speed of the vehicle as it moves along the track, direction of the vehicle and orientation of a particular car of the vehicle. In this embodiment, the detector(s) 12 is a non-contact detector, i.e., a detector that detects an event without the need for the passengers to physically touch or contact the detector. Multiple detectors 12 may be provided on the vehicle, as shown in FIG. 6, or alongside the track, as shown in FIG. 2, to detect actions of individual passengers. The control system may then tally the detected actions as votes, weighted or unweighted, by the amplitude of the detected action. The action having the most votes then controls the response of the vehicle.

For example, if the passengers are informed that raising their hands will cause the vehicle to speed up, and keeping their hands down will cause the vehicle to slow down, if the detectors then detect more hands down than up, the vehicle will slow down.

The control system 10 includes a ground-based computer for processing the input signals from the detector 12 and generating a control signal that varies a parameter of the vehicle 4. The ground-based computer includes an analog to digital converter for digitizing the inputs, a processor and memory for executing a program that processes the digitized inputs, and a digital to analog converter for generating the control signal. The passengers can change a parameter of their vehicle by screaming loudly, by simultaneously raising their hands or by shouting a specific word, i.e., non-contact actions. For example, the louder the passengers scream or shout, the faster they go, or if the passengers all raise their hands at a given time, the vehicle speeds up.

Referring to FIG. 2, the amusement ride includes a motor 14 connected to a variable speed drive 16 for pulling the vehicle 4 to the peak of a section on the track 6. The variable speed drive 16 can include a chain drive and a conventional means for engaging the vehicle. A detector 12 is located on or near the section of the track 6 and positioned to detect an input from the passengers as the vehicle 4 is pulled towards the peak. The control system 10 receives the input signals from the detector 12 and transmits a signal to the motor 14 which speeds up the drive 16 to make the vehicle 4 accelerate up the hill, thus making for a more thrilling ride. As an alternative, the detector could be located in each car 8, rather than on the track 6. In addition, the variable speed drive 16 could be used to increase the vehicle's speed on a flat section of the track, as opposed to on a hill.

Figure 3:
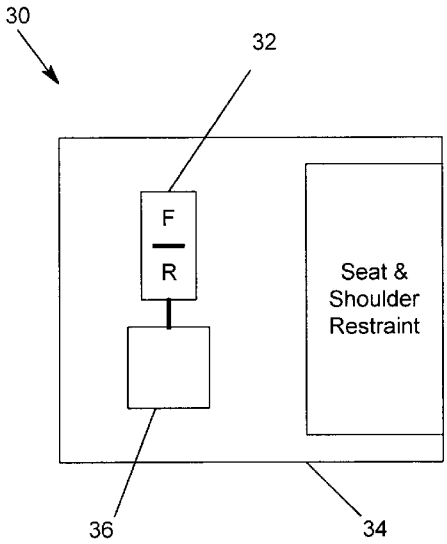
FIG. 3 is a schematic showing a second embodiment of the amusement ride of the present invention.

FIG. 3 shows another embodiment in which an amusement ride 30 has a selector panel 32 in each car 34 that allows a passenger to select an orientation (e.g., forward, reverse) of the car 34. An input signal from the selector panel 32 is sent to a control system 36 which includes a yaw control for each car 34. The yaw control 36 activates a yaw mechanism and changes the yaw of the car 34 in response to the input signal from the selector panel 32. Each passenger can then control the yaw of their car. Thus, different cars may have different yaw angles or orientations at any given point in the ride. The yaw angle of each car may be controlled over an entire 360 degrees or over a smaller angle. For example, the passengers of a first car may select a yaw of 0 degrees and face forward, whereas the passengers of a second car may choose to change the yaw by 180 degrees and face backwards, viewing the ride from where they have been rather than where they are headed. Other equivalent movements can similarly be made using appropriate actuators. The yaw angle may also be controlled by a sensed non-contact event, such as, for example, the sensing of visible or invisible light (infrared); or the sensing of water or another media.

Figure 4:
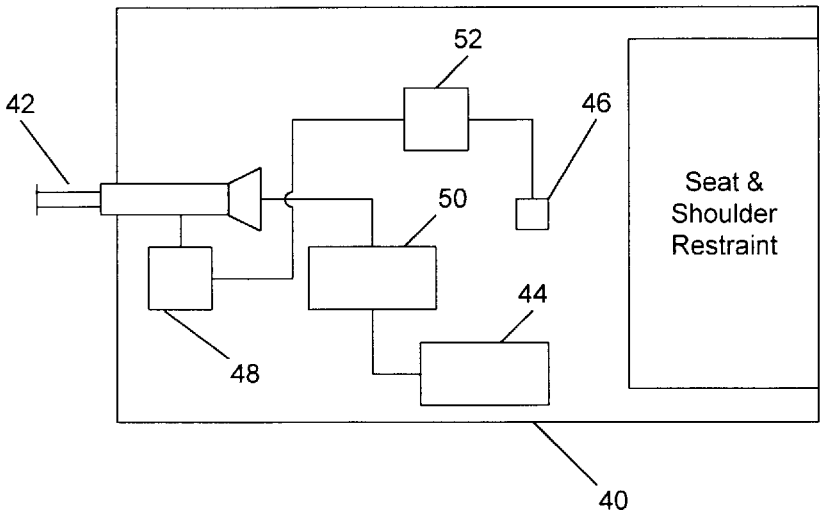
FIG. 4 is a schematic showing a third embodiment of the amusement ride of the present invention.

FIG. 4 shows another embodiment in which each car 40 has a squirt gun 42, a tank of water 44 connecting to the squirt gun 42 and a joystick 46 for aiming the squirt gun 42. The joystick 46 is connected to a microprocessor 52 which is connected to an electric motor 48. The electric motor 48 moves the gun 42 in response to movement of the joystick 46. A pump 50 pumps water from the tank 44 to the squirt gun 42 when the squirt gun is fired. Passengers seated in the car 40 can squirt other passengers, people waiting in line or passersby. The tanks 44 may be filled while the vehicle is being loaded with passengers.

Figure 5:
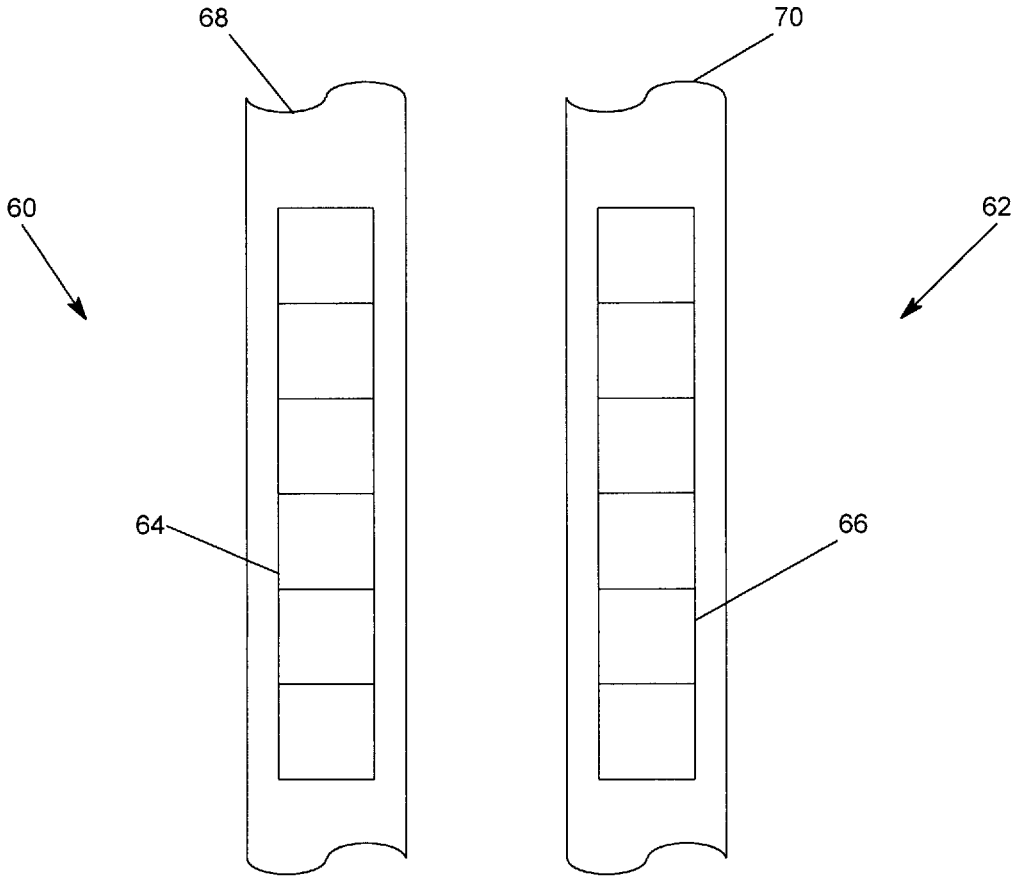
FIG. 5 is a schematic showing a fourth embodiment of the amusement ride of the present invention.

FIG. 5 shows two amusement rides that are side-by-side. Both of the amusement rides (60 and 62) may include features from the embodiments shown in FIGS. 1 through 4. The side-by-side design allows for competition between the two amusement rides. For example, using the features shown in FIGS. 1 and 2, the two vehicles (64 and 66) can have a race to a certain section of the track or path. With each amusement ride (60 and 62) having microphones (as discussed above for FIGS. 1 and 2) spaced along the track or path (68 and 70) or in the vehicles, the passengers in each vehicle (64 and 66) can make their vehicle go faster by screaming louder. The vehicles (64 and 66) may be equipped with squirt guns (as discussed above for FIG. 4). Passengers from the opposing vehicles can then squirt fixed or moving targets, or each other at various times during the ride, such as while they ascend to the peak, while waiting for the ride to begin, or waiting for the vehicle to be unloaded. The spacing between the side-by-side tracks or paths 68 and 70 is large enough for safe operation, yet small enough for passenger interaction (speech, hand signals, facial expressions, water spray, etc.), for example, from about 1 to 10 meters. The vehicles 64 and 66 may alternatively be provided with light sources which the passengers can shoot at targets near the path or on the other vehicle. The light sources can emit visible light or infrared light.

It will, of course, be understood that modifications to the present invention will be apparent to those skilled in the art. Consequently, the scope of the present invention should not be limited by the particular embodiments discussed above, but should be defined only by the claims set forth below and equivalents thereof.

What is claimed is:

1. An amusement ride comprising:

a path;

a vehicle movable along the path;

a non-contact detector for detecting movement of a passenger's body or a sound generated by a passenger's voice; and a control system linked to the detector for varying at least one parameter of the vehicle in response to a passenger movement or sound detected by the detector.

2. The amusement ride of claim 1, wherein the path includes a section having a peak and a variable speed drive for moving the vehicle to the peak, wherein the detector sends a signal to the control system for controlling the variable speed drive to vary speed of the vehicle as the vehicle is moved to the peak, the vehicle speed being varied in response to the signal from the detector.

3. The amusement ride of claim 1, wherein the control system includes a yaw control for each car of the vehicle, and wherein the detector includes a selector panel, with the yaw control responsive to a signal from the selector panel.

4. The amusement ride of claim 1, further including a squirt gun on each vehicle; means for aiming each of the squirt guns; and means for moving each of the squirt guns, the means for aiming and the means for moving linked to the control system.

5. The amusement ride of claim 1 further comprising:

a second path;

a second vehicle movable along the second path; and a second non-contact detector for detecting movement of a passenger's body or a sound generated by a passenger's voice from the second vehicle, the second detector linked to the control system; and the control system varying at least one parameter of the second vehicle in response to a passenger movement or sound detected by the second detector.

6. The amusement ride of claim 1 wherein the detector comprises a microphone.

7. The amusement ride of claim 1 wherein the detector comprises an optical detector.

8. The amusement ride of claim 1 wherein the detector comprises means for voice recognition.

9. The amusement ride of claim 1 further including a variable speed drive for moving the vehicle to a section of the path, wherein the detector sends a signal to the control system for controlling the variable speed drive to vary speed of the vehicle as the vehicle is moved to the section, the speed being varied in response to the signal from the detector.

10. The amusement ride of claim 5 further comprising a yaw drive on the first and second vehicles, with the yaw drive linked to the control system.

11. The amusement ride of claim 1 wherein the path comprises a track.

12. An amusement ride comprising:

a path;

a vehicle movable along the path;

at least one passenger position in the vehicle;

a non-contact detector adjacent to the at least one passenger position for detecting movement of a passenger's body or a sound generated by a passenger's voice;

a propulsion system on the vehicle and the path for moving the vehicle along the path; and a control system linked to the non-contact detector and to the propulsion system.

13. The amusement ride of claim 12 wherein the detector is on the vehicle.

14. The amusement ride of claim 12 wherein the detector is one of an optical detector and a microphone.

15. The amusement ride of claim 12 wherein the detector is a camera and the control system comprises means for digital image processing.

16. The amusement ride of claim 12 further comprising a yaw drive on the vehicle, with the passenger position on the yaw drive, and with the yaw drive linked to the control system.

17. The amusement ride of claim 12 further comprising a plurality of passenger positions, and a detector associated with each passenger position and linked to the control system.

18. A method for operating an amusement ride, comprising:

moving a vehicle holding passengers along a path;

detecting a non-contact action performed by at least one passenger; and controlling vehicle movement in response to a detected non-contact passenger action.

19. The method of claim 18 further comprising the step of detecting a non-contact event by sensing a passenger's voice.

20. The method of claim 18 further comprising the step of detecting a non-contact event by optically sensing movement of a passenger's limb.

21. The method of claim 18 further comprising the step of controlling the vehicle's speed of movement along the path in response to a detected event.

22. The method of claim 18 further comprising the step of controlling the vehicle's orientation in response to a detected event.

* * * * *